United States Patent [19]

Cheng-Pei

[11] Patent Number: 5,029,629

[45] Date of Patent: Jul. 9, 1991

[54] STRUCTURE OF CLOTH CURTAIN LIFT CONTROLLER

[76] Inventor: Sheng Cheng-Pei, No. 12, Yaun Tan Road, Yuan Lin Chen, Changhua, Taiwan

[21] Appl. No.: 487,105

[22] Filed: Mar. 2, 1990

[51] Int. Cl.[5] ..... E06B 9/20

[52] U.S. Cl. ..... 160/300; 160/321; 160/323.1

[58] Field of Search ..... 160/300, 301, 307, 319, 160/321, 323.1, 903

[56] References Cited

U.S. PATENT DOCUMENTS

| | | | |
|---|---|---|---|
| 3,102,584 | 9/1963 | Znamirowski | 160/300 |
| 4,009,745 | 3/1977 | Erpenbeck | 160/323.1 X |
| 4,399,857 | 8/1983 | Honma | 160/323.1 |
| 4,534,396 | 8/1985 | Jung | 160/319 X |
| 4,751,953 | 6/1988 | Appel et al. | 160/323.1 X |
| 4,865,109 | 9/1989 | Sherman | 160/321 |

*Primary Examiner*—David M. Purol

*Attorney, Agent, or Firm*—Bacon & Thomas

[57] ABSTRACT

A cloth curtain lift controller, which includes a driving wheel driven by a cord of beads to engage or be disengaged from a brake member by relative engagement with a ratchet wheel which is controlled by a stopper element to rotate in one direction. A torsion spring is mounted on a brake member with one end secured to the driving wheel so as to bias the driving wheel into engagement with the ratchet wheel. A driven cylinder is secured to the driving wheel to drive a cloth curtain scroll to raise or lower a cloth curtain.

4 Claims, 4 Drawing Sheets

STRUCTURE OF CLOTH CURTAIN LIFT CONTROLLER

BACKGROUND OF THE INVENTION

The present invention relates to a cloth curtain lift controller for efficiently raising or lowering a cloth curtain.

1. Description of the Prior Art

Traditionally, a curtain is raised or lowered directly by a cord. Recently various designs for curtain lift controlling devices have been used. FIG. 1 illustrates a type of curtain lift controller according to the prior art, which is generally comprised of a cap A, a ring B, an axle C, a sliding wheel D, a stopper element E, a counter-stopper element G and a compression spring F. The compression spring F is set between the stopper element E and the counter-stopper element g; The stopper element E comprises a plurality of raised portions E1 respectively seated in the notches D1 of the sliding wheel D; The rod-like body C1 of the axle C is inserted through the sliding wheel D, the stopper element E and the compression spring F permitting its front semi-circular flange C11 to be secured in the semi-circular hole G1 of the counter element G; The ring B comprises a flange B1 set in a hole D3 on the base D2 of the sliding wheel D; a cap A comprises a side-wall portion A1 extending over pulley wheel portion D4 of the sliding wheel D. During operation, the sliding wheel D is rotated by a cord or chain through its toothed portion D5 so as to disconnect its notches D1 from the raised portions E1 of the stopper element E, the ribs D6 of the sliding wheel D are simultaneously driven to carry a curtain scroll to raise or lower a curtain. In operation, the notches D1 of the sliding wheel D must overcome the biasing force from the compression spring F before breaking away from the constraint of the raised portions E1. A disadvantage of this type of curtain lifting controller is that the raised portions E1 of the stopper element E and the compression spring may be easily damaged and affect the operation of the controller. Another disadvantage of this type of curtain lifting controller is that the notches D1 of the sliding wheel D may be easily disconnected from the raised portions E1 of the stopper element E when the connected curtain is directly pulled by an external force. Still another disadvantage of this type of curtain lifting controller is that with any damage to the raised portions E1 of the stopper element E, it will be impossible to stop the connected curtain at a desired position. All the above-said problems can be efficiently eliminated by means of the application of the present invention.

SUMMARY OF THE INVENTION

An object of the present invention is to provide a cloth curtain lifting controller, in which there is provided a driving wheel connected with a torsion spring which has an end secured to a hexagonal sleeve of a brake member to which the driving wheel is releasable engaged so as to engage a ratchet wheel therebetween, which ratchet wheel is constrained from rotation in one direction by a stopper element, so that the driving wheel can be rotated by a cord of beads to drive a curtain scroll and raise or lower a cloth curtain.

Another object of the present invention is to provide a cloth curtain lifting controller, in which the stopper element is secured to a cap, permitting its hooked end to engage the space between the teeth of the ratchet wheel so as to constrain the ratchet wheel from reverse rotation.

Another object of the present invention is to provide a cloth curtain lifting controller, in which the ratchet wheel is mounted on a flange on the driving wheel so as to be engaged between the brake member and the driving wheel, which comprises a plurality of raised portions respectively secured in a plurality of recess holes on a circular head on the brake member.

Still another object of the present invention is to proved a cloth curtain lifting controller, in which the torsion spring is mounted on the brake member with one end fastened in a notch on the hexagonal sleeve of the brake member and its other end secured in a recess hole on the driving wheel, to force the driving wheel to engage the ratchet wheel.

Still another object of the present invention is to provide a cloth curtain lifting controller, in which the driving wheel has two pins extending backward and respectively secured in two notches on the front face of the driven cylinder so that rotation of the driving wheel can simultaneously rotate the driven cylinder.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENTS

Figures 1A, 1B, 1C, 1D:
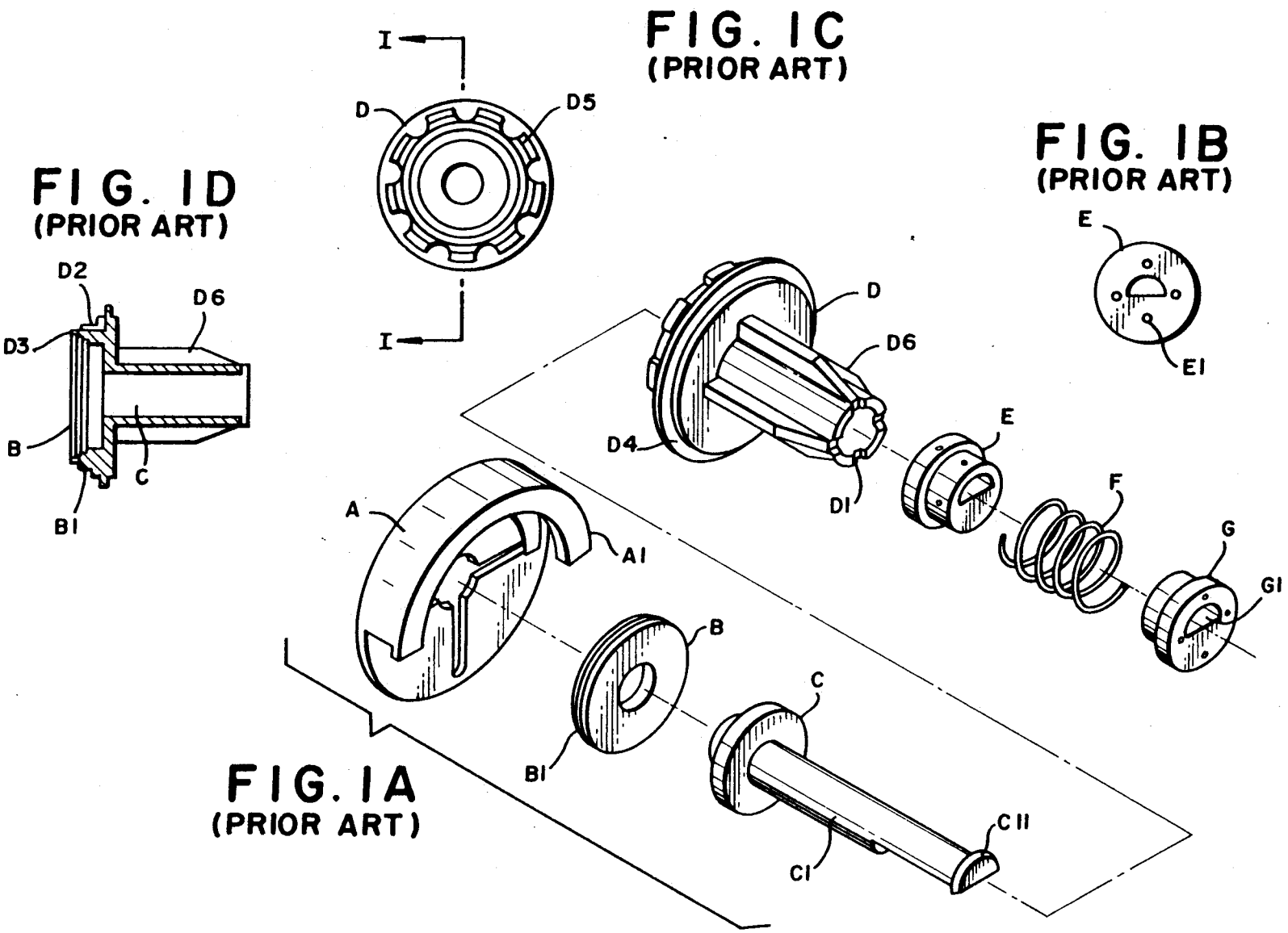
FIG. 1B (PRIOR ART)
FIG. 1C (PRIOR ART)
FIG. 1A (PRIOR ART)
FIG. 1D (PRIOR ART)
FIG. 1A is a perspective exploded view of a cloth curtain lift controller according to the prior art.
FIG. 1B is an end view of element E in FIG. 1A.
FIG. 1C is an end view of element D in FIG. 1A.
FIG. 1D is a cross-sectional view of element D taken along line I—I in FIG. 1C.
Figure 2B:
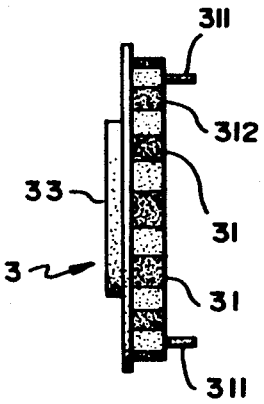
FIG. 2B is a side view of the driving wheel shown in FIG. 2A.
Figure 2A:
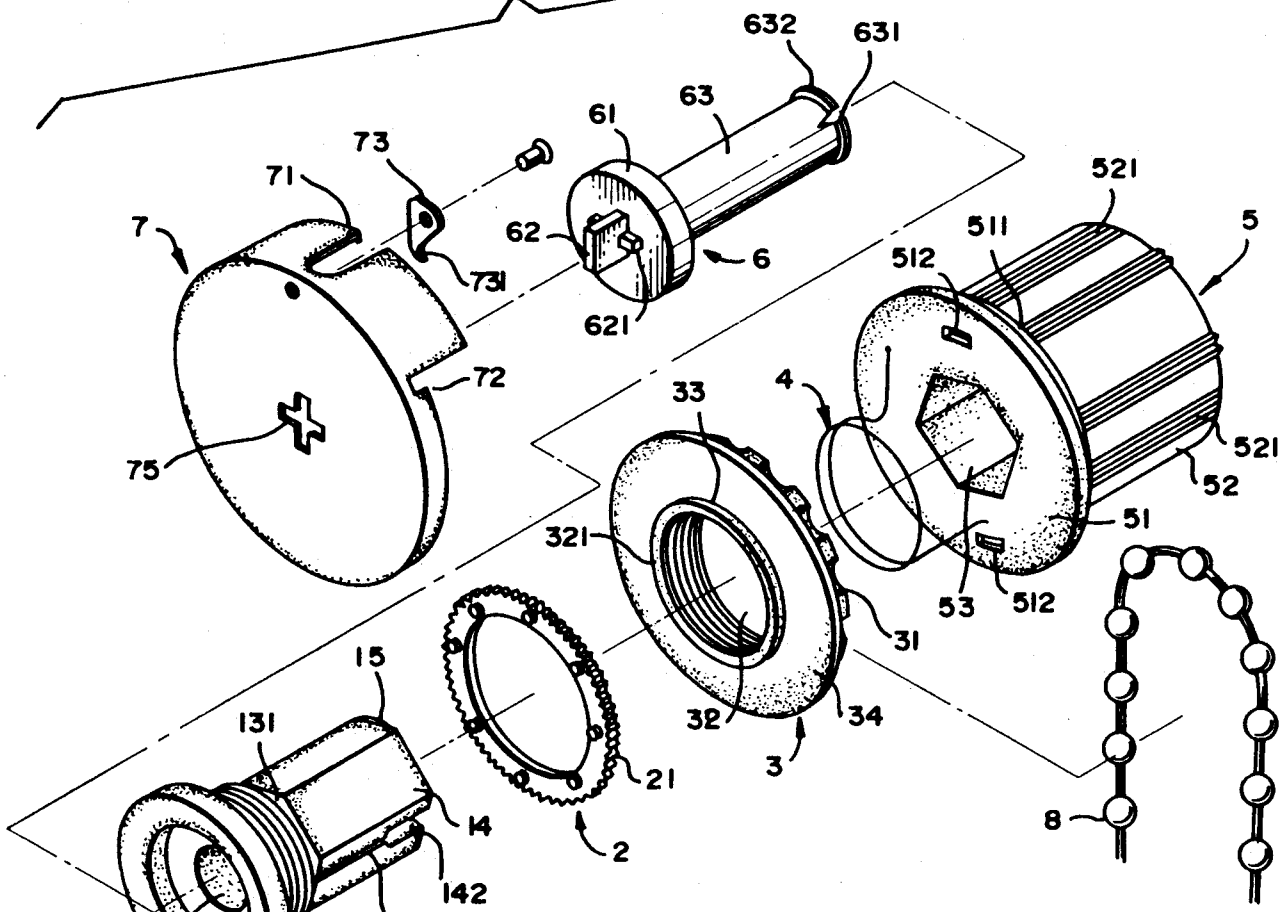
FIG. 2A is a perspective exploded view of a cloth curtain lift controller according to the present invention.

Turning now to the annexed drawings in greater detail and referring first to FIG. 2, therein illustrated is a cloth curtain lift controller in accordance with the present invention and generally comprised of a brake member 1, a ratchet wheel 2, a driving wheel 3, a torsion spring 4, a driven cylinder 5, a spindle 6, and a circular cap 7.

As illustrated, the brake member 1 defines a circular axle hole 11 extending through its central axis, a circular head 12 defining therein an opening 16 and having several holes 121 equidistantly made thereon opening toward the back side, an outer thread 13 located at the back of the circular head 12, and an elongated, hexagonal sleeve 14 extending backward from the outer thread 13 to define therewith a stepped edge 131 for the mounting thereon of the torsion spring 4. Hexagonal sleeve 14 defines two opposite, elongated grooves 141, a notch 142 and two opposite, raised strips 15 on its bottom edge. According to the present invention, the opening 16 of the brake member 1 has an inner diameter larger than the circular axle hole 11.

The ratchet wheel 2 is mounted on the driving wheel 3 and comprises several protruding portions 21 respectively oriented to enter the several holes 121 formed in the head 12 of the brake member.

The driving wheel 3 comprises a flat front surface 34; a flange 33 onto which the ratchet wheel 2 is mounted; a bore 32; an inner thread 321 for the connection with the outer thread 13 o9f the brake member 1; a circular, toothed portion 31 of the brake member 1; a circular, toothed portion 31 for the mounting thereon of a cord of beads 8 through which the driving wheel 3 can be rotated; hole 312;1 and two pins 311 extended backward therefrom.

The torsion spring 4 is mounted on the brake member 1 with one end fastened in the notch 142 of the hexagonal sleeve 14 and its other end secured in the hole 312 of the driving wheel 3, to bias the driving wheel 3 into engagement with the ratchet wheel 2.

The driven cylinder 5 comprises a disc portion 51 defining a circular groove 511 and two opposite notches 512 for the insertion therein of the two pins 311 of the driving wheel 3; an inner tube portion defining therein a hexagonal bore 53 for the insertion therein of the hexagonal sleeve 14 of the brake member 1; and a unitary outer tube 52 having a plurality of sets of raised strips 521. When the hexagonal sleeve 14 of the brake member 1 is inserted in the hexagonal bore 53 of the driven cylinder 5, the two opposite, raised strips 15 of the hexagonal sleeve 14 are respectively engaged with the bottom edge of the inner tube of the driven cylinder 5 so that the ratchet wheel 2, the driving wheel 3 and the torsion spring 4 are retained therebetween thereby permitting the driving wheel 3 to move forward or backward on the hexagonal sleeve 14 of the brake member 1.

The spindle 6 comprises: an elongated body 63 having a retaining flange 632 and a V-notch 631 on its bottom end; and a circular head 61 having an enlarged diameter and having a uni8tary rectangular member 62 extending therefrom with a stop pin 621 transversely crossing therethrough. The arrangement of the V-notch 631 on the retaining flange 632 provides a resilient property such that the bottom end of the elongated body 63 of the spindle 6 can be squeezed to inset it into the circular axle hole 11 such that the retaining flange 632 engages the bottom edge of the hexagonal sleeve 14, and the circular head 61 is received in the opening 16 of the brake member 1.

The circular cap 7 comprises: a projecting sidewall portion 71 having a notch 72 therein for the passing therethrough of the cord of beads; a stopper element 73 movably mounted therein, which stopper element 73 movably mounted therein, which stopper element 73 has a hooked end 731; an inner recess 74; and a cross hole 75. During assembly, the cap 7 is mounted on the circular head 12 of the brake member 1 with the hook-shaped bottom end of its side-wall portion 71 engaged with the circular groove 511 of the driven cylinder 5, permitting the circular head 12 of the brake member 1 to be received in its inner recess 74, such that the rectangular member 62 and the stop pin 621 of the spindle 6 protrudes through the cross hole 75, and the hooked end 731 of the stopper element 73 engages the space between the teeth of the ratchet wheel 2 to prevent the ratchet wheel 2 from reverse rotation. By means of the said arrangement, movement of the spindle 6 and the circular cap 7 are constantly prevented.

Figure 5:
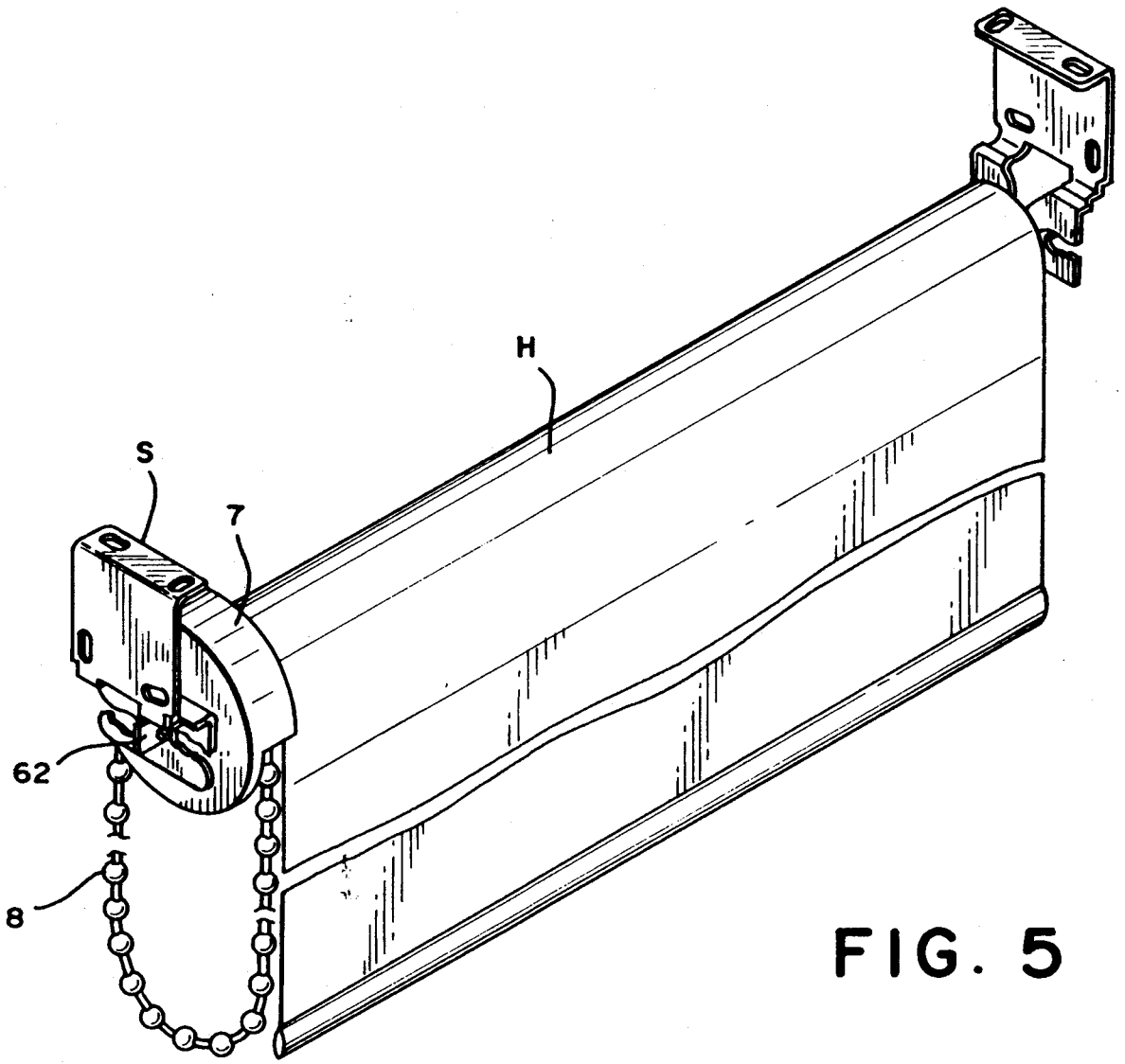
FIG. 5 is a perspective view illustrating an installation of the cloth curtain constructed according to the present invention.

After a cloth curtain scroll H is placed on the outer tube 52 of the driven cylinder 5 and the rectangular member 62 of the spindle 6 is secured to a bracket S during the installation of the present invention, the control device of the present invention can be properly adjusted, permitting the notch 72 of the cap 7 to face downward so that the driving wheel 3 can be rotated by means of the cord of beads 8. (see FIG. 5).

Figure 3:
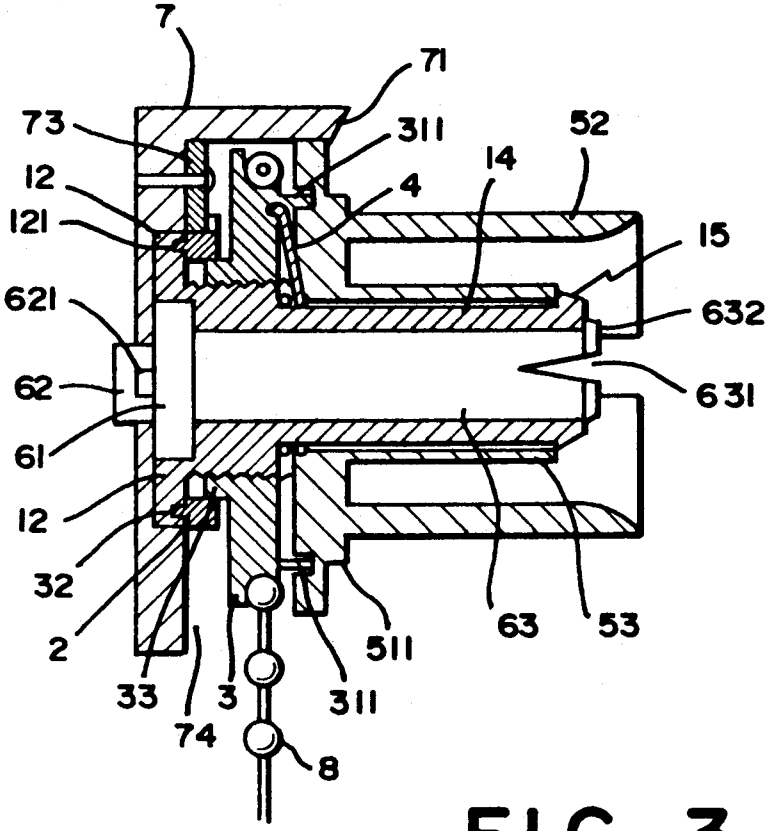
FIG. 3 is a sectional elevational view of a cloth curtain lift controller according to the present invention, illustrating its internal arrangement during the curtain releasing mode.
Figure 4:
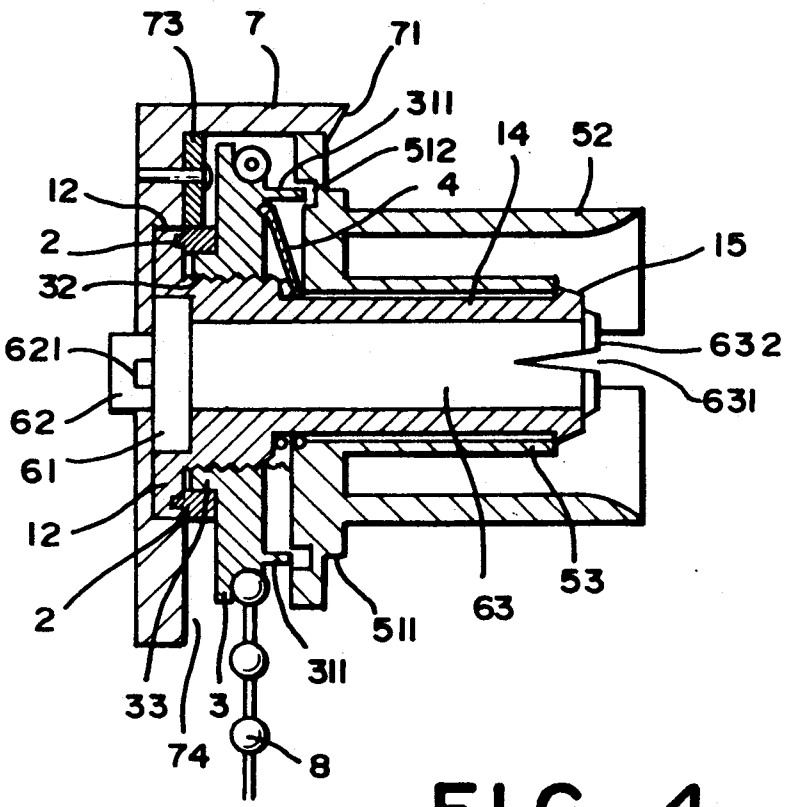
FIG. 4 is a sectional elevational view of a cloth curtain lift controller according to the present invention, illustrating its internal arrangement during curtain raising mode.

Referring to FIGS. 3 and 4, the operation of the present invention is outlined hereinafter. When it is desired to pull down the cloth curtain to which the present invention is connected a pull at one end of the cord of beads 8 downward rotates the driving wheel 3 in a first direction. Because the ratchet wheel 2 is constrained by the hooked end 731 of the stopper element 73 from rotation in this direction, the pins 311 of the driving wheel 3 are inserted in the notches 512 of the driven cylinder 5 by lateral movement of driving wheel 3 caused by the rotation of the driving wheel 3 and its inner threaded 321 along outer thread 13 to disconnect it from the outer thread 13 of the brake member 1. Such notation simultaneously rotates the driven cylinder 5 so as to drive the cloth curtain scroll H and lower the cloth curtain. After the cloth curtain is pulled down the desired amount and the cord released, the torsion spring 4 provides a torsion for on driving wheel 3 to force the driving wheel 3 back into contact the ratchet wheel 2. To raise the cloth curtain, a pull at the other end of the cord of beads 8 rotates the driving wheel 3 in an opposite direction so as to further rotate the driven cylinder 5 and the cloth curtain scroll H to raise the cloth curtain. Because of the ratchet wheel 2 and the stopper element 73, the ratchet wheel 2 can be smoothly rotated in its direction. Therefore, the ratchet wheel 2 does not interfere with the rotation of the driving wheel 3 when raising the cloth curtain.

I claim:

1. A cloth curtain lift controller, comprising:

a driving wheel controlled to be rotated by a cord of beads;

a driven cylinder operatively associated with said driving wheel so as to rotate therewith, the driven cylinder, in turn, being operatively associated with the cloth curtain;

a brake member having mounted thereon a ratchet wheel and being releasably engaged with said driving wheel through a threaded connection;

a torsion spring operatively associated with the brake member and the driving wheel to bias the driving wheel into contact with the ratchet wheel;

a spindle supporting said brake member and having a rectangular member extending from an end thereof with a stop pin crossing therethrough; and a cap having a stopper element secured thereto to control the one-way rotation of said ratchet wheel, and defining a cross hole through which extends the rectangular member and the stop pin to said spindle;

wherein said cord of beads can be manually manipulated to rotate said driving wheel in one direction to firmly engage with, or in an opposite direction to release from said brake member by means of said ratchet wheel, and to simultaneously rotate said driven cylinder to drive a cloth curtain scroll to raise or lower the cloth curtain.

2. A cloth curtain lift controller as claimed in claim 1, wherein said ratchet wheel is mounted on a flange on said driving wheel and engaged between said brake member and said driving wheel, and comprises a plurality of protruding portions respectively engaged in a plurality of holes defined in a circular head on said brake member.

3. A cloth curtain lift controller as claimed in claim 1, wherein said torsion spring is mounted on said brake member with one end fastened in a notch formed on a hexagonal sleeve portion of said brake member and its other end engaged in a hole defined on said driving wheel, to bias said driving wheel into engagement with said ratchet wheel.

4. A cloth curtain lift controller as claimed in claim 1, wherein said driving wheel comprises two pins extending therefrom so as to respectively engage two notches defined on a front face of said driven cylinder, so that the rotation of said driving wheel simultaneously rotates the driven cylinder.

* * * * *